US008870520B2

(12) United States Patent
Mercier et al.

(10) Patent No.: US 8,870,520 B2
(45) Date of Patent: Oct. 28, 2014

(54) SYSTEM AND METHOD FOR EMPTYING A LATCHED CONTAINER

(75) Inventors: Louis Mercier, Levis (CA); Roch Nolet, St-Joseph (CA); Philippe Noel, Breakeyville (CA); Marc Talbot-Pouliot, Saint-Lazare-De-Bellechasse (CA); Michel Fillion, Beaumont (CA); Serge Gingras, Deschambault-Grondines (CA); Jean-Sebastien Guilmette, Quebec (CA)

(73) Assignee: IPL, Inc., Quebec (CA)

( * ) Notice: Subject to any disclaimer, the term of this patent is extended or adjusted under 35 U.S.C. 154(b) by 584 days.

(21) Appl. No.: 13/073,681

(22) Filed: Mar. 28, 2011

(65) Prior Publication Data

US 2011/0274525 A1 Nov. 10, 2011

Related U.S. Application Data

(63) Continuation-in-part of application No. 12/886,094, filed on Sep. 20, 2010, now Pat. No. 8,366,156, which is a continuation-in-part of application No. 29/361,333, filed on May 10, 2010, now Pat. No. Des. 657,106.

(51) Int. Cl.

| | |
|---|---|
| ***B65F 3/12*** | (2006.01) |
| ***B65F 1/14*** | (2006.01) |
| ***B65F 1/16*** | (2006.01) |
| ***B65F 1/02*** | (2006.01) |
| *B65F 3/02* | (2006.01) |

(52) U.S. Cl.

CPC ..... *B65F 1/1615* (2013.01); *B65F 2003/0289* (2013.01); *B65F 1/1468* (2013.01); *B65F 1/16* (2013.01); *B65F 1/02* (2013.01); *B65F 2003/023* (2013.01)

USPC ..... 414/810; 414/407

(58) Field of Classification Search

CPC ..... B65F 3/12; B65F 2003/0289

USPC ..... 414/407, 810

See application file for complete search history.

(56) References Cited

U.S. PATENT DOCUMENTS 1,888,699 A 11/1932 Schwarz
2,951,602 A * 9/1960 Walden et al. ..... 414/411

(Continued)

FOREIGN PATENT DOCUMENTS

WO WO-94/22747 A1 10/1994
WO WO-2006043042 A1 4/2006

OTHER PUBLICATIONS

Office Action issued in Canadian counterpart Application No. 2,735,386.

(Continued)

*Primary Examiner* — James Keenan

(74) *Attorney, Agent, or Firm* — Edwards Wildman Palmer LLP; Howard M. Gitten

(57) ABSTRACT

A method for unlatching a latch on a container includes providing a lifting arm for lifting a latched container. Moving the latched container from a first position to a second position with the lifting arm and unlatching the container by flexing the latch on the container by moving the container from the first position to the second position. The latch includes a first member which is pivotably mounted to a lid. A second member is adapted to selectively engage a projection on a body of the container. An arch member connects the first member to the second member and a handle extends in the direction opposite to the direction in which the arch member extends. The step of deflecting the handle is by movement of the moving member to the flex the latch.

2 Claims, 11 Drawing Sheets

(56) References Cited

U.S. PATENT DOCUMENTS

| | | | | | |
|---|---|---|---|---|---|
| 3,011,666 | A | * | 12/1961 | Dempster et al. | 414/408 |
| 3,130,846 | A | * | 4/1964 | Wender | 414/408 |
| 3,315,828 | A | * | 4/1967 | Dubo | 220/326 |
| 3,687,317 | A | * | 8/1972 | Gagel | 414/411 |
| 3,861,298 | A | * | 1/1975 | Melos | 414/411 |
| 4,155,584 | A | * | 5/1979 | Pracchia | 294/68.26 |
| 4,182,530 | A | * | 1/1980 | Hodge | 294/68.26 |
| 4,363,588 | A | * | 12/1982 | Stickney | 414/408 |
| 4,863,053 | A | * | 9/1989 | Oberg | 414/407 |
| 5,085,341 | A | * | 2/1992 | Hodge | 220/811 |
| 5,094,582 | A | * | 3/1992 | Molzhon | 414/406 |
| 5,203,664 | A | * | 4/1993 | Jensen | 414/407 |
| 5,205,698 | A | * | 4/1993 | Mezey | 414/406 |
| 5,224,744 | A | * | 7/1993 | Michelutti | 414/414 |
| 5,720,589 | A | | 2/1998 | Christenson et al. | |
| 5,738,390 | A | | 4/1998 | Yemini | |
| 5,807,056 | A | * | 9/1998 | Osborn et al. | 414/406 |
| 6,290,093 | B1 | * | 9/2001 | Obriot et al. | 220/835 |
| 6,808,080 | B2 | * | 10/2004 | Spiers et al. | 220/263 |
| 7,121,564 | B2 | | 10/2006 | Hassell | |
| 7,287,665 | B2 | | 10/2007 | Meissen et al. | |
| 7,540,393 | B2 | * | 6/2009 | Wong | 220/324 |
| 8,408,607 | B2 | * | 4/2013 | Michael et al. | 292/95 |
| 8,550,282 | B1 | * | 10/2013 | Libhart et al. | 220/234 |
| 2004/0222231 | A1 | | 11/2004 | Aiken et al. | |
| 2010/0090428 | A1 | | 4/2010 | Meers et al. | |
| 2011/0229292 | A1 | * | 9/2011 | Applewhite et al. | 414/404 |

OTHER PUBLICATIONS

EP Search Report of EP Application No. 11177608.4.

* cited by examiner

SYSTEM AND METHOD FOR EMPTYING A LATCHED CONTAINER

CROSS-REFERENCE TO RELATED APPLICATION

This application is a Continuation-In-Part of U.S. application Ser. No. 12/886,094 filed Sep. 20, 2010, which is Continuation-In-Part of U.S. application Ser. No. 29/361,333 filed on May 10, 2010 in its entirety.

BACKGROUND OF THE INVENTION

The present invention is directed to a system for opening a latched container, and in particular, to a system and method for opening a plastic latch mounted on a cart.

Containers, such as garbage carts for homes, are known in the art. The carts have a container body. In some embodiments, wheels may be provided at a lower corner of the container body. A lid is rotatably affixed to the container to rotate between a first open position and a second closed position.

To prevent animals from gaining access to trash carts or prevent inadvertent spilling of the contents, it becomes necessary to lock the lid in the closed position. As is known in the art, latches are provided. These latches are usually metal pieces. In products such as those manufactured by Rehrig or Norseman, a metal piece formed as a rod is pivotally mounted to the lid. The rod forms a general U-shape in which a first end of the rod is mounted to the lid and the second opposed end of the wire is also mounted to an opposed position on the lid so that the U-shaped rod is pivotally mounted to the lid. The base of the U may be formed as a handle. The sections between the handle and the respective rod ends form, at least in part, an engaging portion for engaging a lip of the container body. In this way, as the latch is pivoted about its ends from a first open position to a second closed position, engaging portions of the latch engage a portion of the container body locking the lid against the container body. To release the lid, the handle is pulled to rotate the latch from the second position releasing the lid from the container body allowing the lid to be rotated into an open position.

It is also known in the art that trash removal has become automated. Waste disposal trucks now use robotic lifting arms to capture lift and empty the trash cart into the truck. However, a latch sufficiently strong to prevent animals such as a raccoon or bear from opening the lid will also prevent the lid from opening when the robotic arm attempts to empty the container. As a result, the driver of the truck must manually release each latch prior to use of the robotic arm; resulting in a waste of time and energy.

Accordingly, a system utilizing a robotic arm and latch which overcomes the deficiencies of the prior art is desired.

BRIEF SUMMARY OF THE INVENTION

A container has a body and a lid rotatably affixed to the body so as to be selectively rotated between a first open position and a second closed position. A latch has a first end adapted to be rotatably affixed to the lid. A second end is adapted to engage the container body. The first end is connected to the second end by an arched member, the arched member capable of flexure when a force is applied at a concave surface of the arched member.

A robotic lifting arm has proximal end for attachment to a truck. Pincers are located on a distal end of the robotic lifting arm and are adapted to grab the cart. An unlocking member disposed at the distal end of the arm includes a sliding mechanism which moves between a first direction and second direction as a function of movement of the robotic lifting arm. The unlocking member includes a moving member which moves between the first direction and the second direction and a finger extending from the moving member so as to come in contact with the latch of a container by moving to the second position so as to unlatch the container. The second position is when the lid of the container is substantially in facing relationship with the truck; an upside down position so that gravity moves the moving member to unlock the lid of the container.

BRIEF DESCRIPTION OF THE DRAWINGS

Other objects, features, and advantages of the present invention will be apparent from the written description and the drawings in which:

FIG. 6 is a top plan view of a latch constructed in accordance with the invention;

DETAILED DESCRIPTION OF THE PREFERRED EMBODIMENTS

Figure 1:
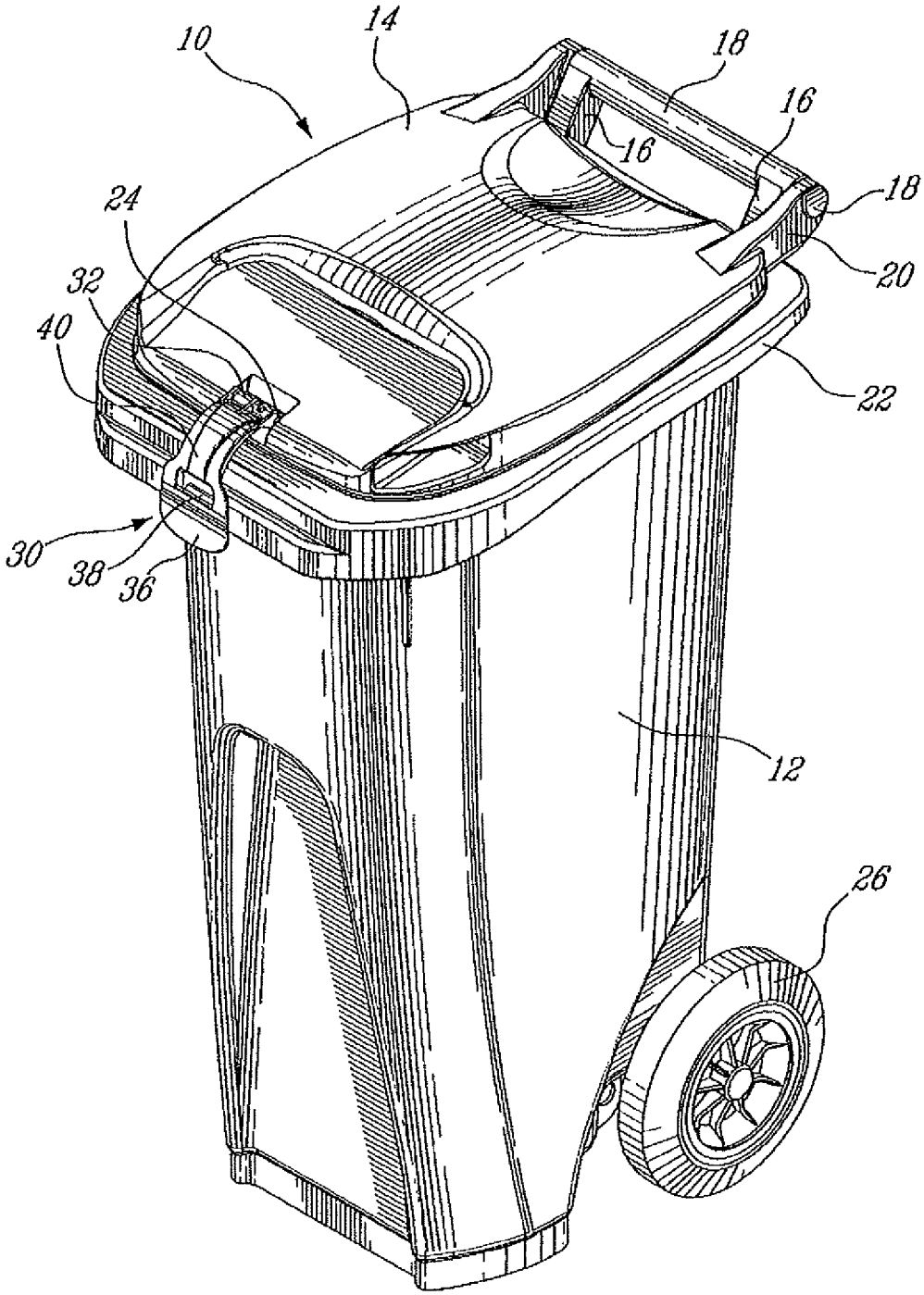
FIG. 1 is a perspective view of a container constructed in accordance with the invention.
Figure 2:
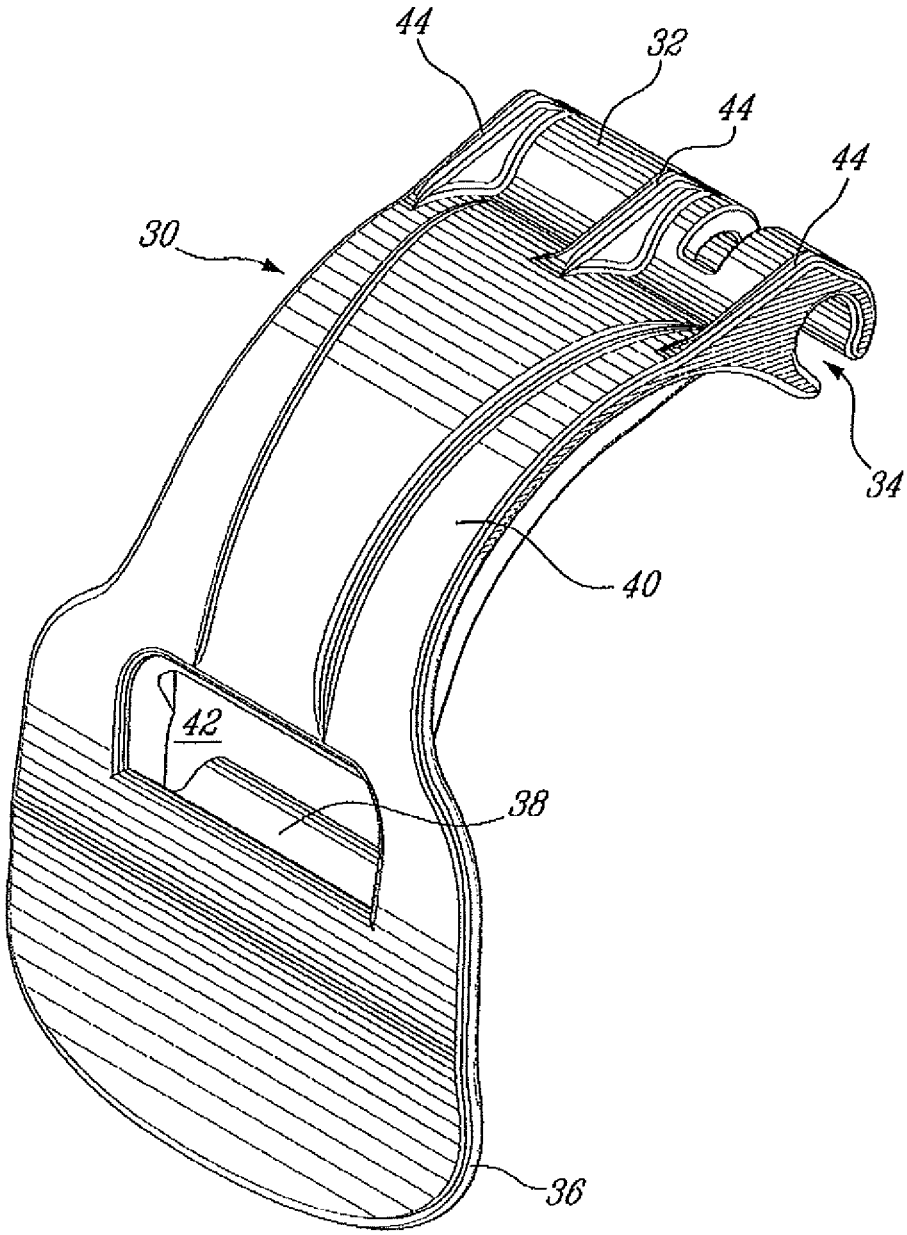
FIG. 2 is a perspective view of a latch constructed in accordance with the invention.
Figure 3:
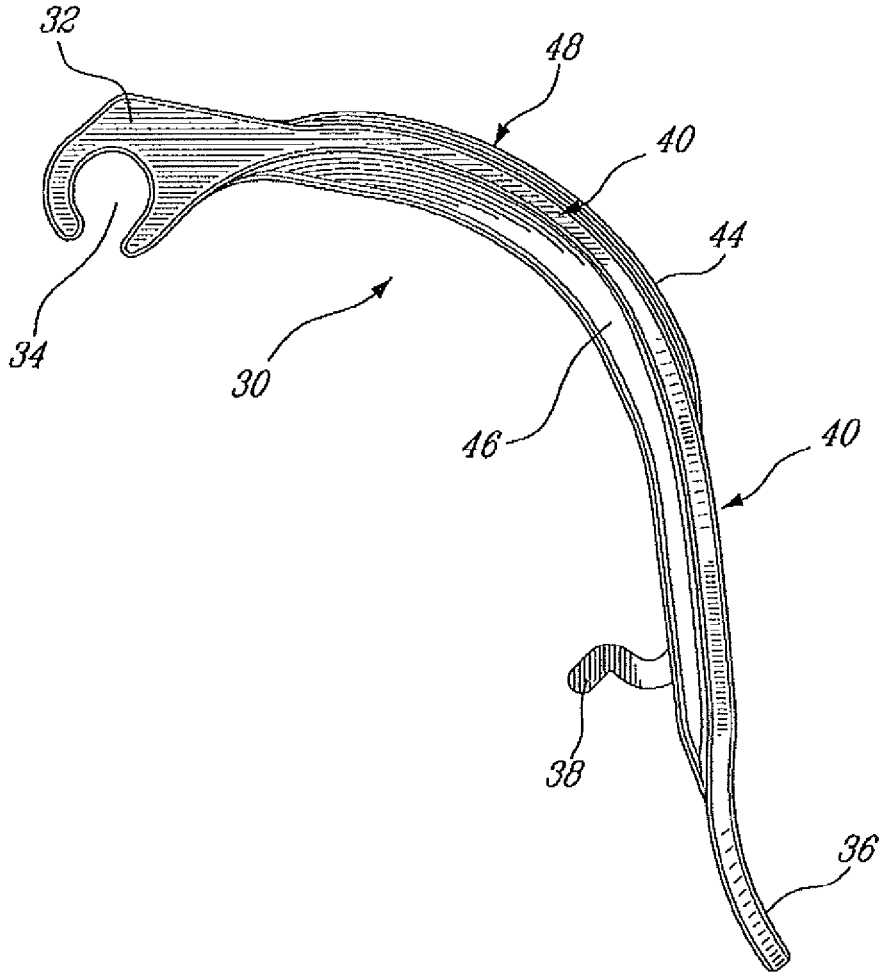
FIG. 3 is a side elevation view of a latch constructed in accordance with the invention.
Figure 5:
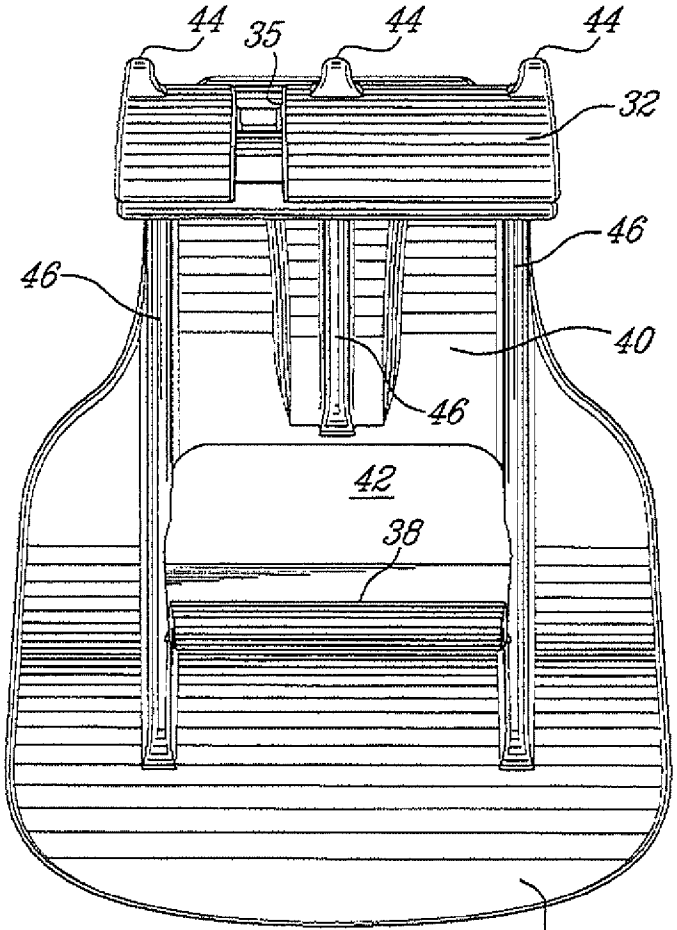
FIG. 5 is a rear elevation view of a latch constructed in accordance with the invention.
Figure 4:
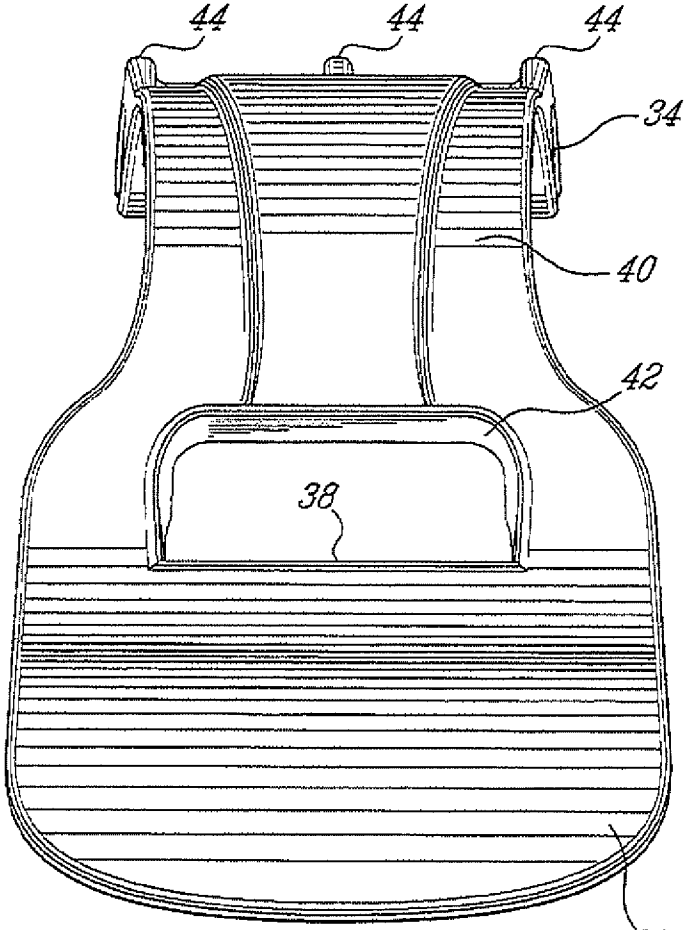
FIG. 4 is a front elevation view of a latch constructed in accordance with the invention.
Figure 7:
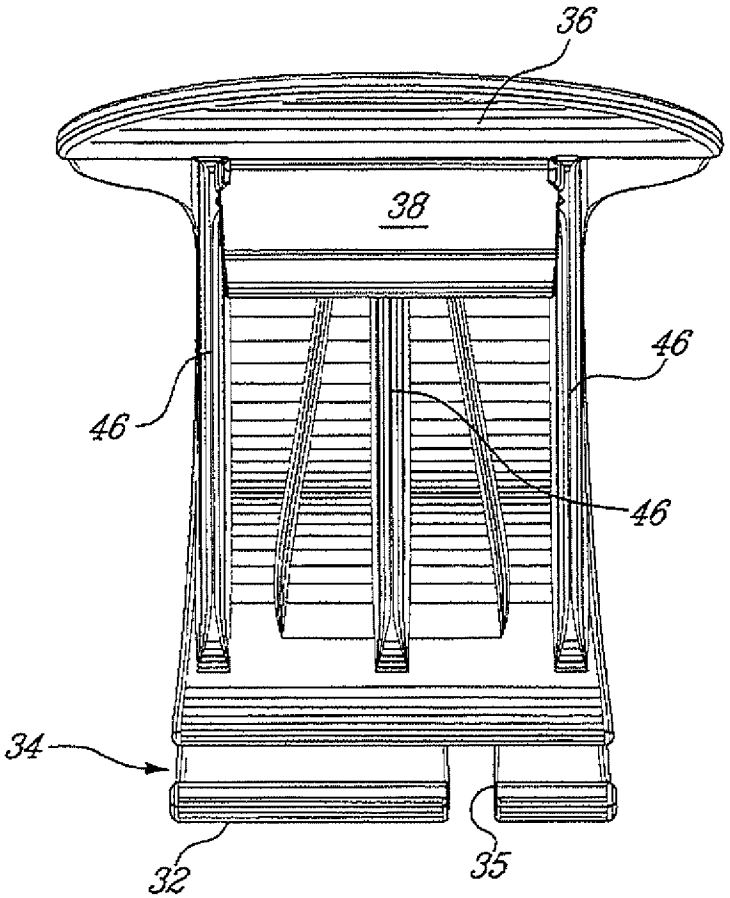
FIG. 7 is a bottom plan view of a latch constructed in accordance with the invention.
Figure 8:
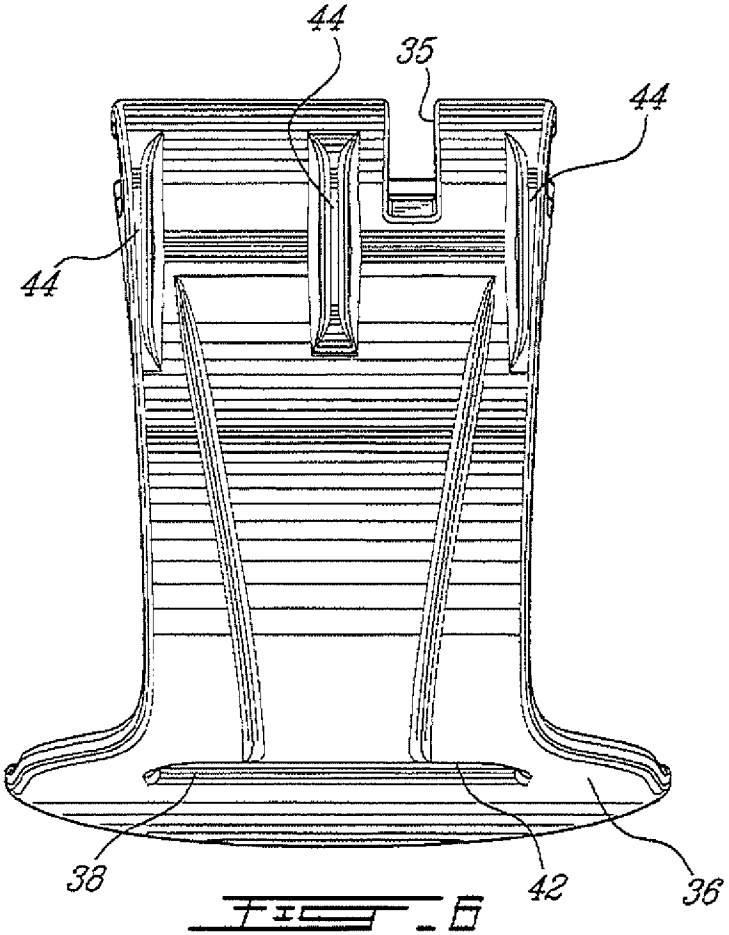
FIG. 8 is a perspective view of the container showing the latch in an open position.
Figure 8:
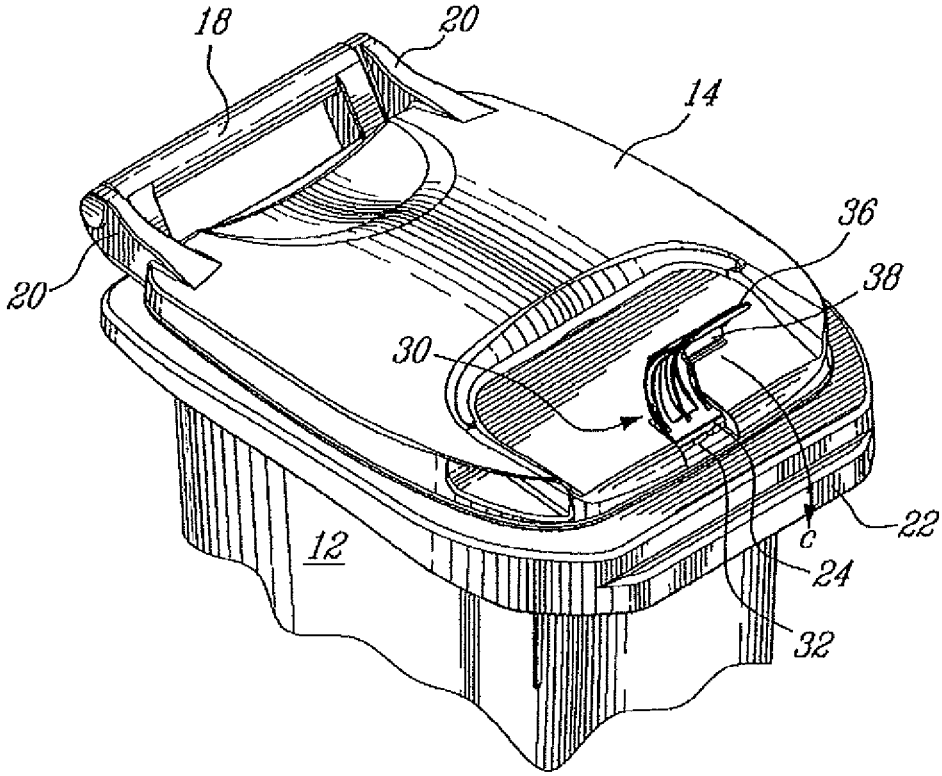
Figure 10:
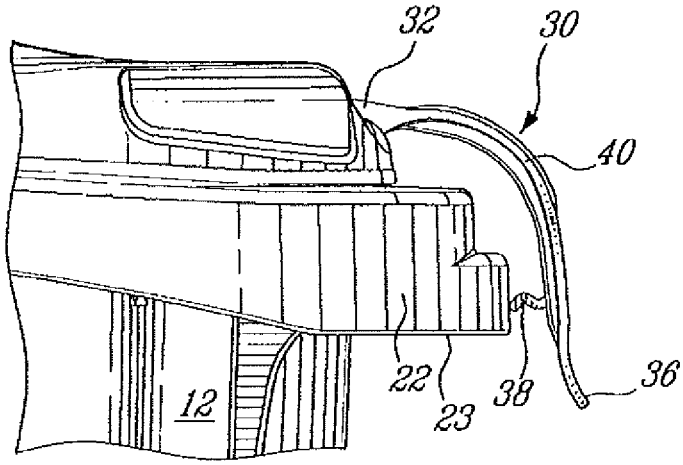
FIG. 10 is a side elevation view of the container showing the latch in an intermediate position in accordance with the invention.
Figure 11:
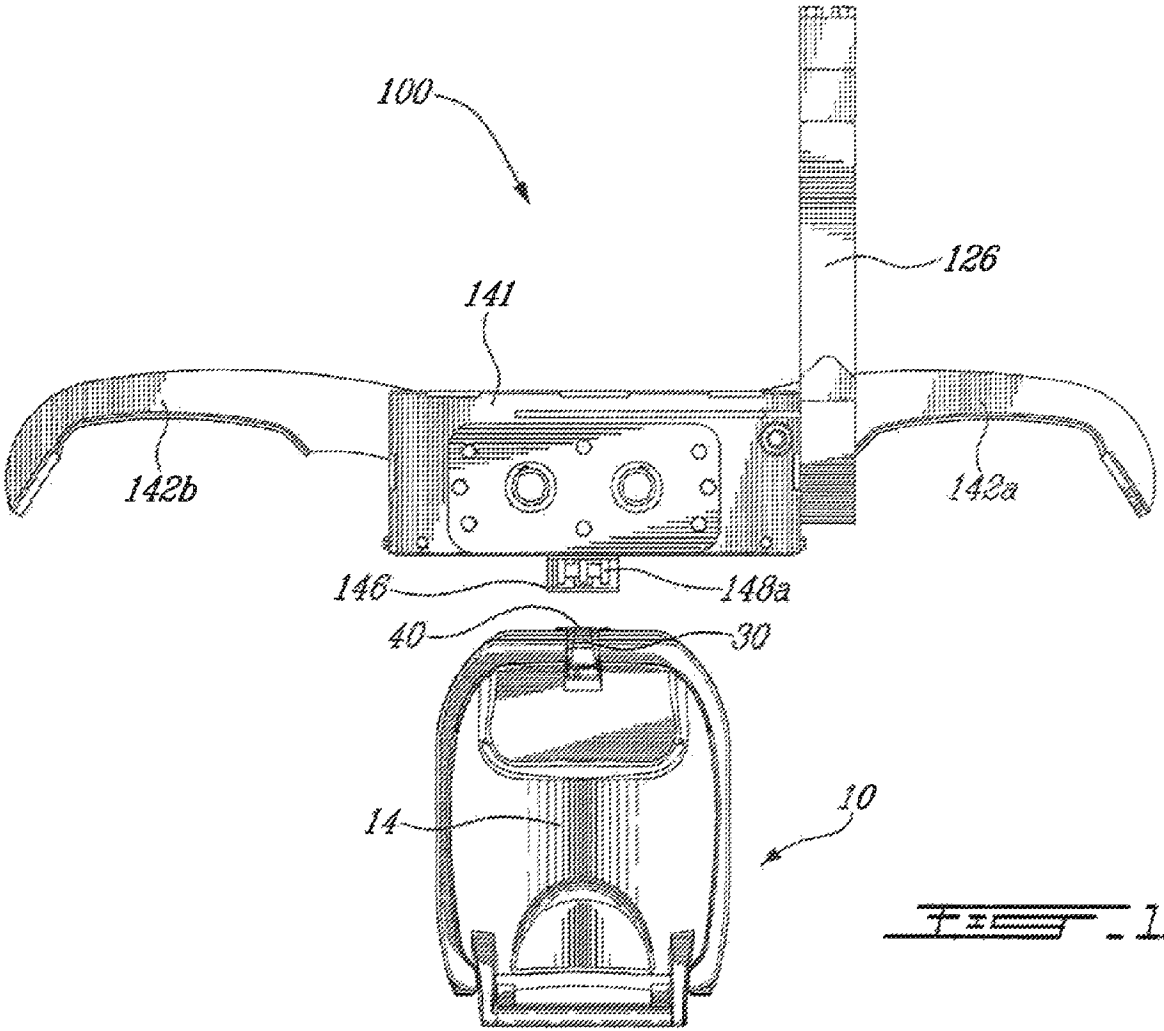
FIG. 11 is a top plan view of the system constructed in accordance with the invention prior to activation.

Reference is generally made to FIGS. 1, 8, and 10 in which a container as a cart, generally indicated as 10, constructed in accordance with the invention is provided. Cart 10 includes a container body 12 having a projection in the form of an upper rim 22 extending about a top, and the opening formed at the top of body 12. Support members 16 extend from the rim 22. A handle 18 is supported by support members 16 spaced away from housing 12.

Wheels 26 are affixed to housing 12 as in a manner known in the art so that cart 10 is mobile.

As will be seen below, rim 22 is provided by way of exemplary, but nonlimiting embodiment. Any projection from body 12 is contemplated by the present invention. Rim 22 may merely be a ridge, a lip, a platform, or a projection capable of being engaged by a latch 30. Support member 16 may also extend from body 12, rather than rim 22.

A lid 14 sized to cover an opening (not shown) of body 12 is rotatably disposed on body 12. Lid 14 is formed with wings 20 for rotatably engaging handle 18 as known in the art. In this manner, lid 14 may be moved from a first closed position, as seen in the figures, about the pivot provided by handle 18 to an open position (not shown) to allow access to the cart body 12. A pivot 24 is formed within lid 14. In a preferred, nonlimiting embodiment, pivot 24 is at an edge of lid 14 opposed to an edge from which lid 14 is rotatably affixed to body 12.

Figure 9:
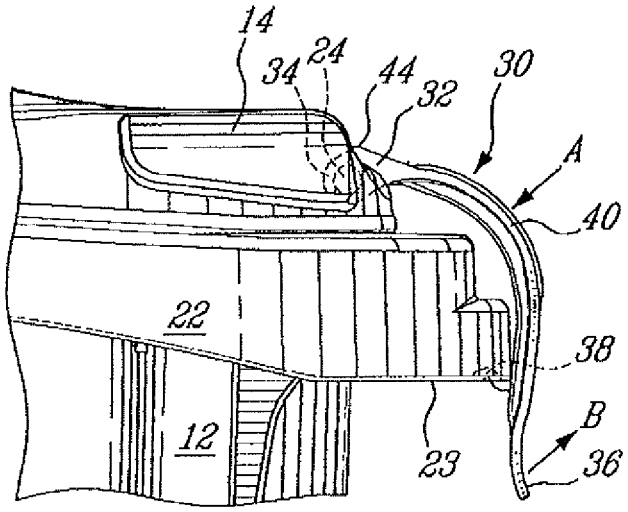
FIG. 9 is a side elevation view of the container showing the latch in the closed position in accordance with the invention.

Latch 30 is pivotally disposed about pivot 24 and is adapted to engage a projection such as that formed by rim 22 to lock lid 14 in the closed position. Accordingly, latch 30 is rotatable between a first open position, as shown in FIG. 8, which allows rotation of lid 14 and a closed position, as shown in FIG. 9, which locks the lid 14 to body 12 in the closed position.

Reference is now also made to FIGS. 2-7 in which latch 30 is shown with greater particularity. Latch 30 includes a first member 32 which is a pivot member. First member 32 is formed with a receiving portion, in an exemplary but nonlimiting embodiment, an opening 34 therein, adapted to receive pivot 24 of lid 14. Latch 30 includes a second member 36 acting as a handle. An arch member 40 connects first member 32 with second member 36. Handle portion 36 is formed with a catch 38. Catch 38 is a projection adapted to engage a projection of housing body 12 such as rim 22.

In a preferred nonlimiting embodiment, pivot member 32, handle 36, and arch member 40 are formed as a unitary construction; preferably formed of a plastic material. Arch member 40 is flexible such that a force applied at a convex surface 48 of latch 30 will deflect arch member 40 flattening arch member 40 to lengthen latch 30. Arch 40 has sufficient resiliency that it will substantially return to its original shape upon removal of the force at convex surface 48 of arch portion 40.

In a preferred but nonlimiting embodiment, to reduce the amount of material required for latch 30, without sacrificing strength, flexibility, and resiliency, various structures are incorporated into latch 30. A plurality of support arches 44 extend along convex surface 48 between arch member 40 and pivot member 32. Additionally, a second set of support members 46 comprised of one or more support arches, in a nonlimiting exemplary embodiment, extend along a concave surface of arched member 40, and may extend from the handle portion of second member 36 to the pivot portion of second member 32. An opening 42 may be provided in second member 36 adjacent catch 38. Catch 38 may be any shape capable of engaging a projection from housing 12, such as rim 22 while also being dimensioned to allow for disengagement by flexure of handle 36 as will be discussed below.

During use, latch 30 is pivotally mounted to lid 14. Pivot 24 is received within opening 34 of pivot 32 of latch 30. To lock cart 10, latch 30 is pivoted from a first open position (FIG. 8) in a direction of arrow C to an intermediate position (FIG. 10).

In the intermediate position, it becomes apparent that latch 30 is dimensioned so that catch 38 is positioned along latch 30 so that when no force is applied to latch 30, catch 38 is disposed at a position in which it does not engage rim 22, in this instance the position is above a bottom surface 23 of the projection provided by rim 22. However, as seen in FIG. 9, when a force is applied to the convex surface 48 of arched member 40, latch 30 is lengthened so that catch 38 moves below bottom surface 23 of rim 22 to engage rim 22. Latch 30 is resilient such that once the force in the direction of arrow A is removed, latch 30 will substantially return to its original position. However, catch 38 engaging rim 22 prevents complete return, and therefore the restorative force of latch 30 keeps latch 30 in the closed position by the force applied by catch 38 against lip 22. It should be noted that a force in the direction of arrow A not only extends the length of latch 30, but also continues to move handle 30 in the direction of arrow C so that it is the action of pressing against latch 30 at arch member 40 which closes and locks the cart as shown in FIGS. 1 and 9.

To open the cart, it should be noted that handle portion 36 is slightly curved in that portion of second member 36, which extends from catch 38. Handle 36 is curved in a direction opposed to the curve of arch member 40, and in a preferred embodiment, to a lesser extent (more obtuse curve) than the curve of arched member 40. This facilitates applying a force in direction of arrow B to latch 30 at handle portion 36. Applying a force at handle portion 36 pulls catch 38 away from rim 22 releasing latch 30 allowing rotation into the open position shown in FIG. 8. It should be known that the surface of catch 38 may be rounded or cammed to allow catch 38 to slide along rim 22 as it is released rather than requiring movement of handle portion 36 sufficient to rotate catch 38 to clear rim 22 or to flatten catch 40.

In a preferred nonlimiting embodiment, latch 30 must be sufficiently rigid so as to maintain a grip about pivot 24 and sufficiently rigid along its length to maintain catch 38 in position to prevent opening of lid 14. However, latch 30 must be sufficiently flexible to allow flattening of latch 30 without the need for excessive force, i.e. not beyond a manual force easily applied by an ordinary person and to allow handle 36 sufficient movement to allow catch 38 to either be deflected by rim 22 or disengaged by rim 22. Latch 30 also exhibits restorative properties so that once released, latch 30 returns to its original shape. In the most preferred embodiment, latch 30 must maintain these properties across a temperature range from −30° C. to 30° C. In a preferred, but nonlimiting embodiment, latch 30 is unitary nylon construct.

A slit 35 is formed within pivot member 32. Slit 35 mates with a projection (not shown) formed on lid 14. Slit 35 is off centered along the axis of second member 32 which prevents mistaken installation of latch 30. Latch 30 will only fit about pivot 24 of lid 14 when slit 35 is aligned with the projection guaranteeing normal orientation.

Reference is now made to FIGS. 11-14 wherein a system generally indicated as 100 for a latch and a robotic lifting arm, by way of nonlimiting example, capable of opening a latched crate is provided. System 100 includes a cart 10 having a latched lid in which a portion of the latch extends below or beyond the lid, such as latch 30 by way of nonlimiting example and a lifting arm constructed as robotic arm 120; by way of nonlimiting example.

Robotic lifting arm 120 includes a proximal end 122 adapted to be affixed to a truck (not shown) as known in the art. Robotic arm 120 has a first section 124 extending from proximal end 122 and a second section 126 extending from first section 124 at an angle. A container manipulating assembly 140 is affixed to a distal end 128 of robotic lifting arm 120.

Container manipulating assembly 140 includes a motor block 141 for housing a motor. A grabber assembly which in a preferred nonlimiting embodiment, includes grabber members 142*a*, 142*b* extending from opposed sides of motor block 141 and move between a first, open, position and a second, closed or pincing, position under the control of a motor (not shown) preferably housed in motor block 141. It is understood that through gearing the motor may be housed anywhere along system 100. Grabber members 142*a*, 142*b* when in the closed or second position surround and grab container body 12 of cart 10 and that any other structure which grabs to lift a container may be substituted for grabber members 142*a*, 142*b*. (See FIG. 12, FIG. 13). When grasped, in accordance with the invention, cart 10 is captured by grabber members 142*a*, 142*b* such that latch 30 is in substantial facing relationship with robot lifting arm 120.

An unlatching member 144 includes a guide member 146 which, in a preferred exemplary, but nonlimiting embodiment, is a pathway or chute extending from grabber members 142*a*, 142*b* towards second arm section 126. A moving member 147 is disposed within guide member 146 and is capable of moving within guide member 146, under the control of gravity, from a first position away from latch 30 to second a position towards and/or beyond latch 30. Moving member 147 includes wheels, 148*a*, 148*b* to facilitate movement within guide member 146 of moving member 147. It should be noted, that wheels are used as an exemplary, nonlimiting embodiment and may be omitted by utilizing low friction elements such as Teflon or lubricant such as oil, grease or silicon spray, or any combination thereof so long as moving member 147 is capable of substantially consistent movement at a speed sufficient to dislodge latch 40 as moving member 147 moves from the first position to the second position as will be described below. A finger element 149*a* extends from moving member 147 outside of the path formed by guide member 146 and is sufficiently sized so that to engage a latch, such as latch 30 as moving member 147 moves from the first position to the second position.

Figure 12:
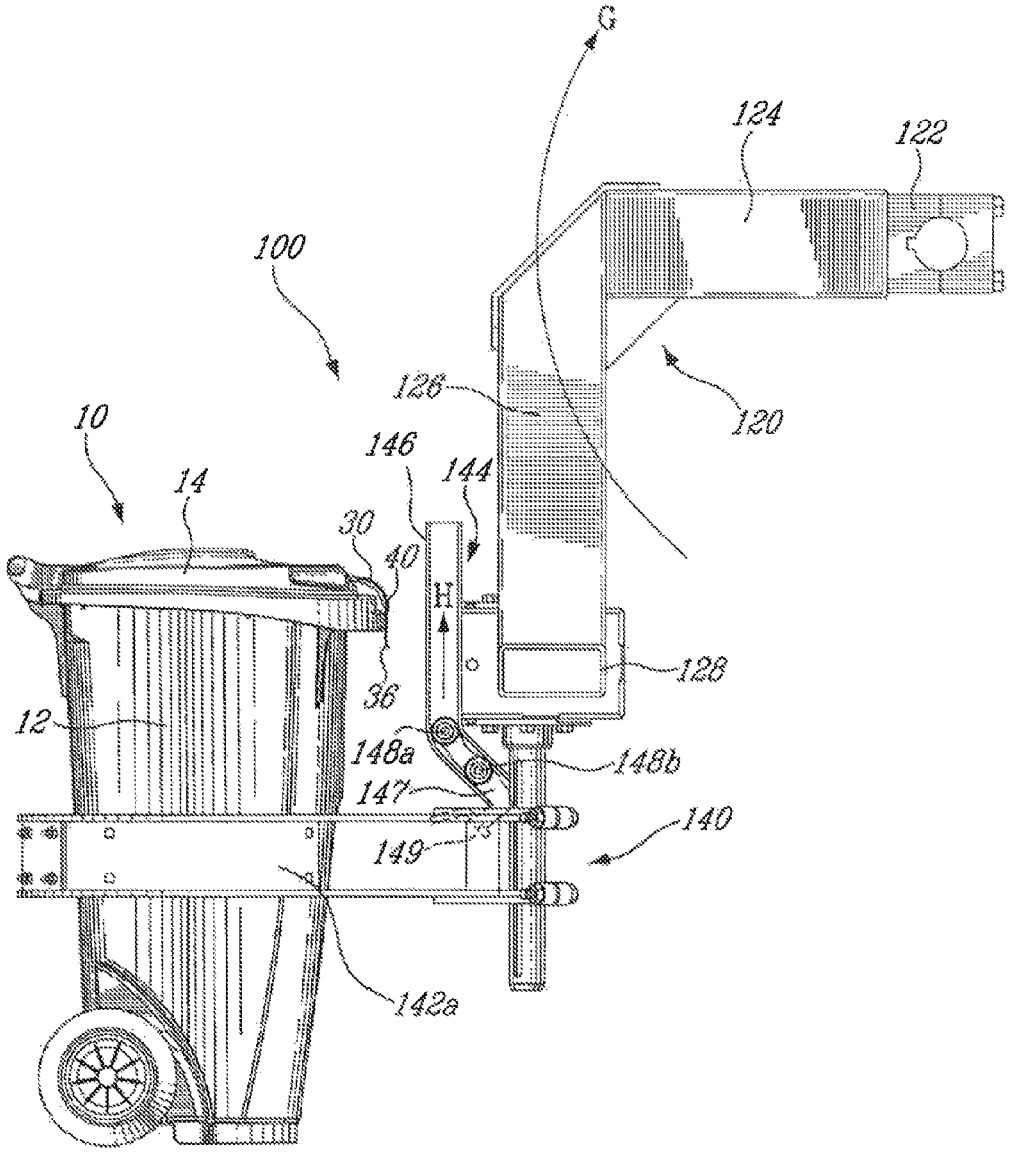
FIG. 12 is a side plan view of the system constructed in accordance with the invention in a first position in which the container is grasped.
Figure 13:
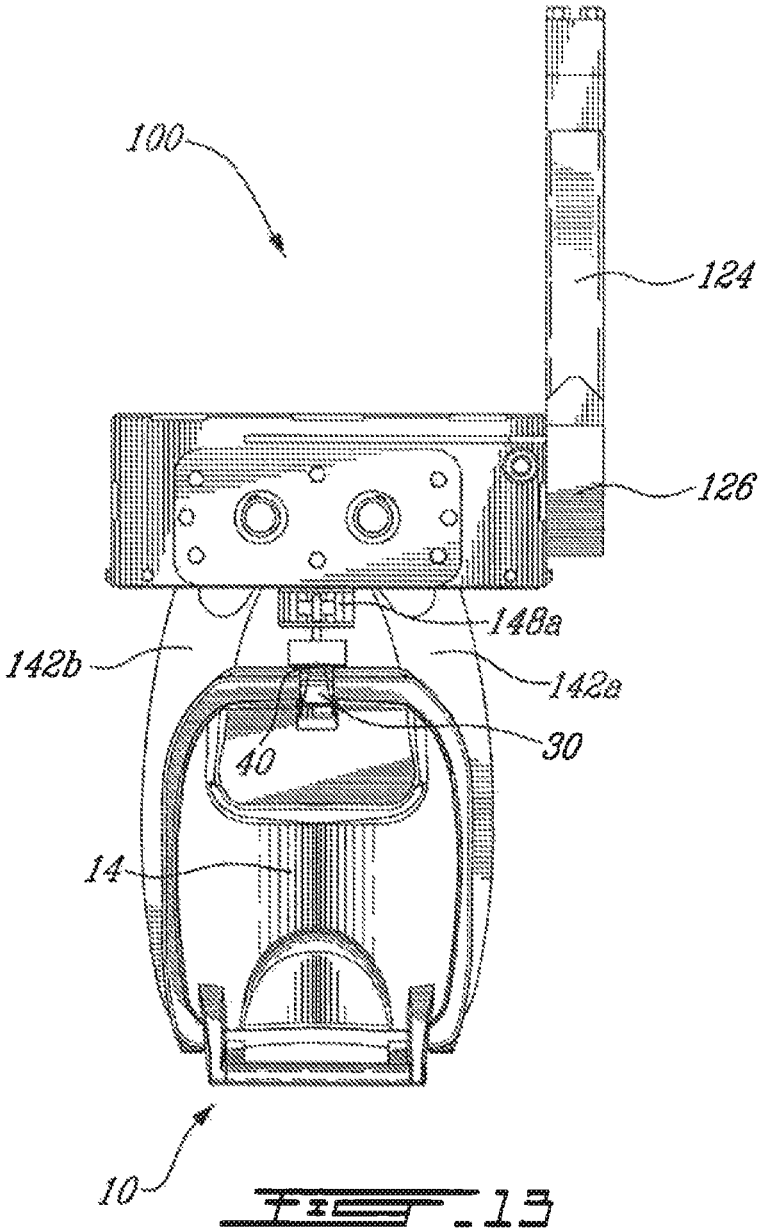
FIG. 13 is a top plan view of the system showing the container grasped in accordance with the invention.
Figure 14:
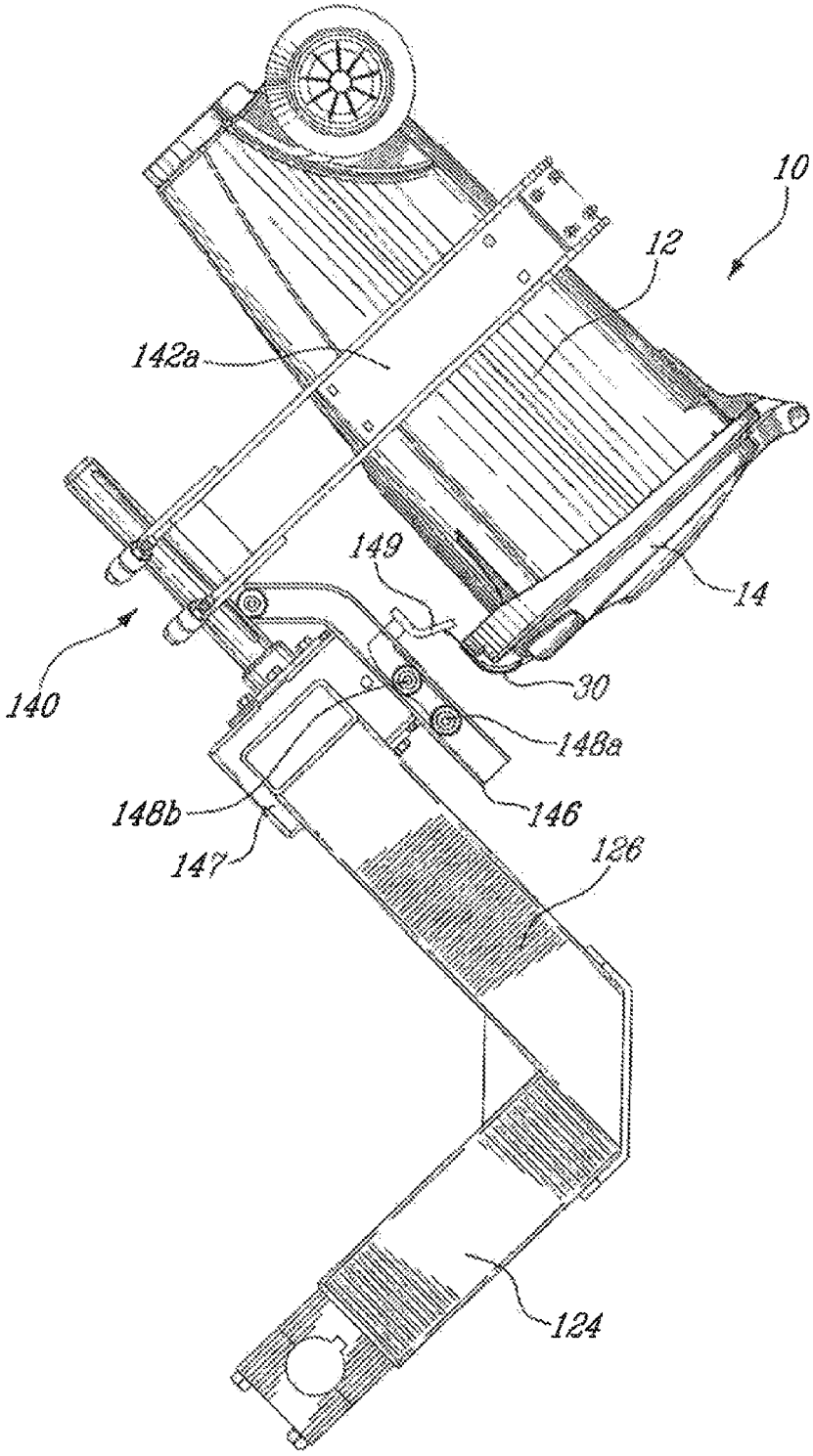
FIG. 14 is a side elevation view of the system in accordance with the invention with the container disposed between the first and second position in accordance with the invention.

Operation of system 100 is illustrated by FIGS. 12 and 14, which have substantially the same frame of reference, and shows arm 120 as it moves through an arc generally defined by arrow G. Gravity, acting on moving member 147 causes moving member 147 to move substantially in the direction of arrow H as lifting arm 120 moves. It follows that finger element 149 moves in the direction of arrow H and engages latch 30. In this nonlimiting example, finger 149 engages handle portion 36 to flex handle portion 36 and disengage latch 30 as described above. It should be well understood that the system may work with any lid and latch in which contacting a lower extremity of the latch causes disengagement of the latch.

By providing a system in which the standard motion for emptying a cart into a waste disposal truck unlatches a latched cart, a latch sufficiently strong to resist animal break in may be utilized without the need for the operator of the truck to manually open each cart prior to dumping. By providing a lifting arm which utilizes gravity to move an unlatching mechanism from a first position to a second position; the second position being at least an unlatching position, a simple mechanical structure is provided to consistently unlatch latched carts. By providing a plastic latch rotatably affixed to the lid of the cart and capable of flexure to engage the body of the cart and a disengaging handle, a simple structure capable of being mass produced at low cost is provided for latching the cart in a manner that prevents animal break in.

It is to be understood that while certain forms of the present invention have been illustrated and described herein, the present invention is not to be limited to the specific forms or arrangement of parts described and shown.

The invention claimed is:

1. A method for unlatching a latch on a container comprising the steps of:

providing a lifting arm for lifting a latched container;

moving the latched container from a first position to a second position with the lifting arm;

unlatching the container by flexing the latch on the latched container by moving the latched container from the first position to the second position;

providing a moving member along the lifting arm, the moving member moving from a third position to a fourth position as a function of moving the latched container from the first position to the second position;

engaging the latch on the latched container to flex the latch with the moving member as the moving member moves from the third position to the fourth position;

wherein the latch includes a first member adapted to be pivotably mounted to a lid, a second member adapted to selectively engage a projection on a body of the latched container, and an arch member connecting the first member to the second member, and a handle extending in the direction opposite to the direction in which the arch member extends; and further comprising the step of deflecting the handle by movement of the moving member to flex the latch.

2. The method of claim 1, wherein the container is closed in the first position and opened in the second position.

* * * * *